United States Patent [19]

Fricke et al.

[11] 4,085,648

[45] Apr. 25, 1978

[54] ELECTRONIC SOUND SYNTHESIS

[75] Inventors: Jobst Fricke, Cologne; Wolfgang Geiseler, Berlin, both of Germany

[73] Assignee: CMB Colonia Management-und Beratungsgesellschaft mbH & Co. K.G., Cologne, Germany

[21] Appl. No.: 588,486

[22] Filed: Jun. 19, 1975

[30] Foreign Application Priority Data

Jun. 21, 1974 Germany ..... 2429871

[51] Int. Cl.[2] ..... G10H 1/02

[52] U.S. Cl. ..... 84/1.24; 84/1.27,1.01; 84/1.11

[58] Field of Search ..... 84/1.01, 1.09, 1.11, 84/1.12, 1.24, 1.17, 1.19, 1.21, 1.22, 1.23, 1.27; 179/1 A, 1 D, 1 VL, 130.1 TC; 333/28 T; 325/424

[56] References Cited

U.S. PATENT DOCUMENTS

| | | | |
|---|---|---|---|
| 2,142,580 | 1/1939 | Williams | 84/1.23 X |
| 2,235,249 | 3/1941 | Baxter | 179/1 D |
| 2,287,105 | 6/1942 | Kannenberg | 84/1.21 |
| 2,478,973 | 8/1949 | Mahren | 84/1.23 X |
| 3,525,796 | 8/1970 | Franssen | 84/1.24 X |
| 3,624,265 | 11/1971 | Yamada | 84/1.23 X |
| 3,836,693 | 9/1974 | Ichikawa | 84/1.19 |
| 3,911,776 | 10/1975 | Bergel | 179/1 D X |

*Primary Examiner*—Ulysses Weldon
*Attorney, Agent, or Firm*—Flynn & Frishauf

[57] ABSTRACT

Method and apparatus for synthesis or imitation of sounds of musical instruments wherein the partial tone structure is a function of the volume or intensity impression to be effected with a listener, and controlled by controlling the relative content of signal contribution in the overall signal of component signals in such a manner that the timbre of the resulting sound will simulate that of softly played (piano) or loudly played (forte) sound; in a system, signal sources representing the signal components are relatively mixed, for example by a control volume control, and applied to an amplifier; or a signal now U.S. Pat. No. 4,064,482, Maisch et al. source generating a composite signal including all components is connected to a plurality of filters and subsequently connected amplifiers of controllable pass frequency and damping (amplification) characteristic to synthesize the timbre of piano, or forte music regardless of actual volume of output.

7 Claims, 3 Drawing Figures

ELECTRONIC SOUND SYNTHESIS

The sound emitted by a musical instrument usually comprises a fundamental note determining the pitch and a number of overtones, whose frequencies usually have a real, in particular, a harmonic numerical relationship with the fundamental frequency. In an amplitude/frequency diagram the fundamental tone and the overtones (generic term: component or partial tones) form a pattern in the manner of spectral lines of different heights, which is referred to as the "partial tone structure". The frequencies and amplitudes of the overtones with respect to that of the fundamental tone determine the sound colour or timbre and are typical for various types of musical instruments (e.g. violins, trumpets, oboes and others).

It is also known that sounds from musical instruments of the same pitch but of different volume levels differ from each other not only in respect of amplitude but also in respect of the partial tone structure that is to say in respect of the relative amplitudes of the various component tones and possibly also the frequency position of signal envelope maxima relative to the fundamental tone. See Schmann's acoustic law of displacement and discontinuity.

This difference regarding relative amplitudes of the various component tones simulates to the human ear softly played ("piano") or loud ("forte") sound although there may not be any change in pitch and the actual output energy level has not changed.

It has been proposed to use an electrical instrument (see German Disclosure Document DT-OS 2,041,426) in which storage of each sound (or rather: signal representing the sound) of prescribed pitch is effected in a plurality of intensity stages (with the respective typical partial tone structures) and then reproduced as required. For the recording and storage operations it is possible to use rotating sound film discs or magnetic tape loops. A number of different versions corresponding to the various intensity stages are stored on the sound film discs or the magnetic tape loops there, in parallel tracks, with respect of each sound of a prescribed pitch. These versions have the partial tone structures typical of the respective intensity stages. Corresponding to the various intensity stages there may exist continuous transition areas between the tracks, so that a discrete storage position is not required for each volume level. The desired value of volume level is therefore obtained by scanning a suitable strip of the recording.

Both the recording and the scanning of a plurality of intensity stages of a tone having continuous transition areas can be satisfactorily achieved only by overcoming very difficult mechanical and acoustical problems.

It is an object of the present invention to provide methods and systems for the true fidelity production of sounds of different volume level having differing partial tone structures in accordance with the commanded volume level, without the necessity of storing sounds having the timbre of a plurality of different volume levels, and without storing transitions values situated between these values of volume level.

SUBJECT MATTER OF THE PRESENT INVENTION

Briefly, a signal source provides a source signal which includes all of the component signals which occur in the electrical signals to be produced - either by a single source, or by a plurality of sources; frequency selective means are then provided, for example inherent in the source, or sources, or separately connected thereto, together with amplitude selective means and so connected to the respective frequency selective means that a transfer function of signals to an output amplifier, or loudspeaker will obtain such that the electrical signals are so delivered that the timbre of "piano", or soft and "forte", or loud sounds is synthesized. The frequency selective means are so arranged that they have a band pass of predetermined pass frequency; and the amplitude is so arranged that the transfer characteristic or transfer factor (damping, or amplification) for at least one formant region and the pass frequency will depend on the loudness value, or loudness characteristic which the resulting output signal is to have.

When practicing the invention, it is no longer necessary to store sound signals representing a plurality of volume levels of sound of a given pitch and the intervening transition areas and to provide means for the selective interrogation of a determined storage region. In practice this was possible only using mechanical displacement means between the record carrier and the scanning element. Mechanical displacement means are complicated and liable to failure. In accordance with the invention, sound production is effect by a purely electrical method involving substantially smaller space requirements. The sound production may be synthetic, that is to say without sound storage.

The inventive concept will now be explained in more detail with reference to the drawing as applied to illustrative practical examples, wherein.

Figure 1:
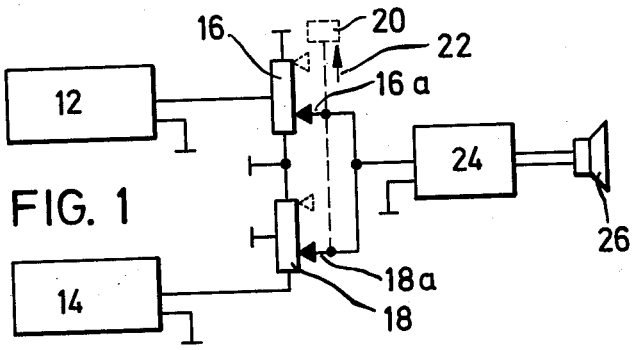
FIG. 1 is a schematic circuit diagram of a first embodiment of the invention wherein the desired signal versions are produced by adding variable components of the output signals of two signal sources.

Embodiment of FIG. 1: at least two signal versions are derived, from a sound which is to be produced with a predetermined volume value. The two signal versions correspond to two volume stages including between them the predetermined volume value. The signal versions have the partial tone structures specific to said volume stages. A signal corresponding to the volume value of the desired sound is produced by addition of the two signal versions having amplitudes in proportion to the difference between the volume level to be produced and the respective volume stage and, if necessary, adjustment of the level of the resulting signal to the level corresponding to the desired volume value.

The two signal versions can be produced by storage and playback, or by the aid of suitable signal generators. In the simplest case, which however gives a fairly good approximation of reality, two signal versions are prepared or produced for each sound of predetermined pitch. These signal versions correspond to different volume impressions, for example one signal version with a partial tone structure such as is possessed by the piano version of the particular sound, and a second signal version having a partial tone structure such as is possessed by the forte version of the respective sound. These two signal versions are delivered in the circuit arrangement according to FIG. 1 from a first signal source 12 (piano version) and a second signal source 14 (forte version). The signal sources may in each case comprise a magnetic head, which scans a track of an associated magnetic tape loop storing the corresponding signal version. The signal sources may however also comprise known types of oscillation generator filter network combinations, which deliver the desired signal versions.

The output of the signal source 12 delivering the piano version is connected to the centre tap of a resistance potentiometer 16, whose ends are grounded. The output of the signal source 14 delivering the forte version is connected to one end of a second resistance potentiometer 18, similar to the resistance potentiometer 16, the other end of the resistance potentiometer 18 being connected to ground. The resistance potentiometer 18 also has a centre tap connected to ground. The resistance potentiometers have respective sliders 16*a* and 18*a*, which are mechanically coupled together and further coupled to an operating member 20, for example a key. The operating member 20 is provided with a restoring spring schematically indicated by the arrow 22, which urges it into a rest position wherein the sliders 16*a*, 18*a* are situated in initial end positions indicated by the dashed triangles, corresponding to the grounded ends of the two resistance potentiometers.

The sliders 16*a*, 18*a* are electrically connected together and further connected to the input of an amplifier 24, to the output of which there is connected a loudspeaker 26, or some other device for utilizing or storing the produced sound signal.

OPERATION

When the sliders 16*a*, 18*a* are in the rest position represented by the dashed lines, the sound signal has zero value. If the operating member 20 is pressed downwardly as seen in FIG. 1, the slider 16*a* first sweeps over that portion of the potentiometer 16 which is situated between the upper grounded end and the centre tap coupled to the signal source 12. Thus, the piano version of the sound signal appears with increasing amplitude at the slider 16*a*. The signal source 14 is not applied at this time because the portion of the potentiometer 18 which is swept by slider 18*a* lies between two grounded terminals (in principle this portion of the potentiometer resistance 18 could be omitted). When the sliders 16*a*, 18*a* are downwardly displaced beyond the centre taps the amplitude of the piano version reduces while at the same time the amplitude of the forte version increases correspondingly. Thus, at the output of the amplifier 24 there will appear a signal which, corresponding to the adjustment of the sliders 16*a*, 18*a*, will contain a more or less large component of the piano version and a complementary component of the forte version of the sound signal. In the lower end position of the sliders the component of the piano version is equal to zero and the signal at the input of the amplifier 24 consists exclusively of the forte version. Therefore, by suitable choice of the output amplitudes of the signal sources 12 and 14 as well as of the resistance values of the potentiometer resistances 16 and 18, a sound of increasing volume will be produced at the loudspeaker 26, upon depressing the operating member 20. The partial tone structure of this sound varies with the volume in such a manner that a true fidelity sound impression is the result. Therefore, a piano tone will evoke in the listener the impression of a softly played tone, irrespective of how loudly it is reproduced by the loudspeaker 26, that is to say irrespective of how high the amplification factor of the amplifier 24 is adjusted. (The amplifier 24 may comprise, for example, an amplifier for a conventional disc record and magnetic tape reproducer or it may comprise the low frequency section of a radio receiving set).

Figure 2:
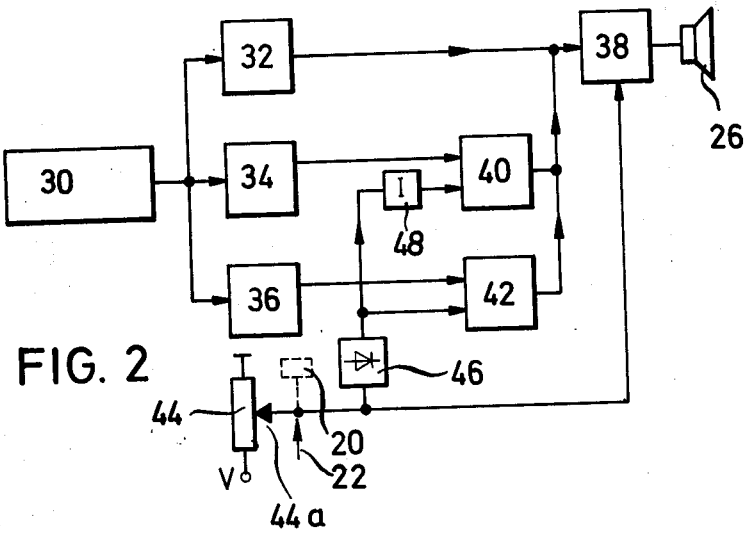
FIG. 2 is a schematic block diagram of a second embodiment of the invention wherein the desired signal versions are produced by various filtering operations performed upon a fundamental signal.

The circuit arrangement represented in FIG. 2 uses frequency selective circuits having an electrically controllable transfer characteristic for separating the component tones corresponding to at least two versions of different volume stages of the sound in question from a supplied base signal. These component tones are characteristic of the volume value desired for said sound. The originating signal, i.e. the base signal, contains all component tones which could occur within the volume range. The frequency selective circuit arrangement is controllable both in respect to (a) the pass frequency and (b) damping. The partial tone structure typical of the volume value to be produced is thus filtered out.

The circuit arrangement according to FIG. 2 contains a signal source 30, whose output signal comprises components corresponding to all the component tones which could be present in the volume range to be covered, e.g. from pianissimo to fortissimo. Again, as is assumed in FIG. 1, the required volume range begins with zero and comprises two component ranges, of which the first one, which is the component range adjacent to the value zero, is characterised by a first partial tone structure, while in the following second partial range there is a transition with increasing volume to another second partial tone structure.

Three filter circuits 32, 34 and 36 are connected to the output of the signal source 30. The filter circuit 32 passes the fundamental tone frequency directly to the signal input of a controllable amplifier 38. The filter circuit 34 passes the component tones of the first partial tone structure excepting the fundamental tone, and the filter circuit 36 passes the component tones of the second partial tone structure with the exception of the fundamental tone. The component tones passed by the filter circuit 34 are again required to correspond to a comparatively small volume whilst the component tones passed by the filter circuit 36 are required to correspond to a comparatively large volume. The outputs of the filter circuits 32, 34 and 36 are in each case coupled to the signal input of the controllable amplifier 38; the outputs of filters 34, 36 first pass through controllable amplifiers 40 and 42 respectively. The amplification factor of the amplifiers 38, 40 and 42 is controllable by a control voltage, which is delivered to the control voltage input of the respective amplifier. Thus, the damping of the outputs from filters 34, 36 is controlled. The outputs of the amplifiers 40 and 42 are then coupled to the signal input of the amplifier 38, to whose output there is connected a loudspeaker 26 or any other device for utilizing the generated signal. The pass frequency of filters 34, 36 is likewise controlled by the control voltage.

For the production of the control voltage a potentiometer 44 is used, which is connected between a bias voltage source V and ground. The slider 44*a* of the potentiometer is adjustable by an operating member 20', for example a key of a musical instrument. The voltage at the slider 44*a*, which is variable in its amplitude by means of the operating member 20', is delivered directly to the control voltage input of the amplifier 38; it is also delivered, through a threshold stage 46, to the control voltage input of the amplifier 42 connected "forte" filter 36 through an inverter 48, to the control voltage input of the amplifier 40 connected to "piano" filter 34.

The intensity of the fundamental tone is therefore directly controlled by the voltage at the slider 44*a* and by means of the operating member 20 can be varied from zero up to a maximum value. So long as the voltage at the slider 44*a* does not exceed the threshold value of the threshold value stage 46, the position of the slider 44*a* is without influence upon the output signals of the amplifiers 40 and 42. In a certain lower intensity range of the fundamental tone below this threshold, and as transmitted filter 32, the amplifier 40 will deliver, because of the presence of the inverter 48, its maximum output signal at the input of the amplifier 38 there will then be present a signal mixture with the first partial tone structure. When the voltage at the slider 44*a* increases further, the threshold value of the threshold value stage 46 is finally exceeded and the control voltage at the control voltage input of the amplifier 40 begins to reduce, whilst simultaneously the control voltage at the control voltage input of the amplifier 42 increases. Additionally, the pass frequency of the filters is controlled as aforesaid. Accordingly there takes place a continuous transition from the partial tone structure determined by the filter circuit 34 to the partial tone structure determined by the filter circuit 36, until finally there is present at the input of the amplifier 38 only the partial tone structure determined by the filter circuit 36. In practice of course more than three "channels" may be present.

Figure 3:
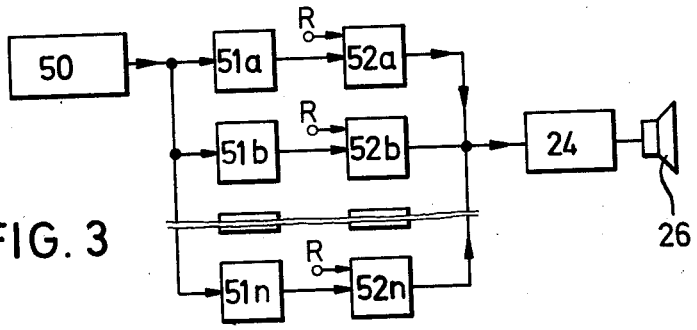
FIG. 3 is a simplified schematic block diagram of a third embodiment of the invention wherein the sounds are synthesised in each case from the individual partial tones.

In a third embodiment, sound production is effected in a fully synthetic manner, that is to say the partial tone structure of the sound to be produced is composed of several component tones. Referring to FIG. 3. An oscillator circuit 50 oscillates at a relatively high frequency, at whose output there are connected as many frequency divider circuits 51*a* to 51*n* as the number of component tones which are required. The frequency divider circuits 51 produce from the output frequency of the oscillator circuit 50 a signal of the respective component tone frequency. The output signals of the frequency divider circuits are delivered respectively to a circuit arrangement 52*a* to 52*n*, whose transfer capability (damping or amplification factor) is controllable by an electrical signal at a suitable control voltage terminal R. The outputs of the circuit arrangements 52 are connected together and to the input of an amplifier 24, to whose output a loudspeaker 26 is connected. The control voltages may be produced in a manner similar to that for the circuit arrangement according to FIG. 2. The transfer capability of the circuit arrangement 52 is so adjusted in dependence upon the position of an operating member, such as a key, that the correct partial tone structure is produced for each volume. In the circuit arrangement according to FIG. 3 transient phenomena may also be taken into consideration by imparting to the circuit arrangement 52 a desired transient characteristic, which may be achieved, for example, by time constant elements, filters with suitable transient characteristics and the like.

The embodiment of the invention according to FIG. 3 can be further modified in that the desired sound is synthesised from the component tones, but the composite signal is then subjected to a modification by filters, which in this case do not require to be controllable.

In so far as an addition or superposition of signals is effected, it is preferable to employ signals having a mutal phase-correct association of the component tones which is correct regarding phase. Stated in other words the frequencies to be added should be of proper phase, so as to avoid the occurrence of weakened component tones by interference or undesirable beat phenomena. The correct phase relationship can be ensured by adopting suitable storage of the respective signals, correct regarding phase, or by using signals produced by generators, or by deriving the component signals from a standard by frequency division, multiplication, synchronisation and the like.

A correct phase relationship of the component tones can also be ensured by the use of adjustable phase correction members, or else the influence of phase deviations by the added signals can be compensated by the use of suitable distortion correctors.

According to one feature of this invention the fundamental tone can be excluded from the above mentioned measures. It is possible to generate the fundamental tone in the conventional manner at a continuously variable volume (signal amplitude) and to superimpose upon it volume-characteristic partial tone structures which are free of the fundamental tone, these being generated in the above indicated manner. Because the described measures refer in this case only to the partial tone structure which is free of the fundamental tone, it is possible in this case to permit larger tolerances and deviations without resulting in any discernable impairment of the sound quality.

The signal versions which are employed should preferably have a partial tone structure corresponding to a high volume level e.g. forte version, and a high quality, that is to say both in respect of the fundamental tone as well as the other component tones the ratio of the useful signal to the noise component should be large.

The mixing of the signal versions to a varying degree can be carried out by conventional scanning of two or more adjacent recording tracks (for example magnetic sound tracks) with a single pickup (e.g. magnetic head). The components coming from the respective tracks are therefore determined by the relative position of the active scanning element with respect to the tracks and can be varied by corresponding variation of this relative position. Recording of continuous intermediate values, as is necessary in the known methods, is therefore not necessary in this case.

The described methods and the circuit arrangements according to FIGS. 1, 2, and 3 relate respectively to a sound of predetermined sound colour and prescribed pitch. For the purpose of generating a number of sounds of different pitches it will be necessary to use a suitable number of circuit arrangements of the described type (which under certain circumstances may obviously have certain components common to all of them, e.g. the final amplifiers 24, and, in the case of FIG. 2 or 3 also the oscillator 50 and so on). Should it be desired to produce sounds of different sound colours (for example to use selectively sounds of a stringed instrument or a woodwind instrument), then those components which determine the sound colour, i.e. the partial tone structures, should be designed to be interchangeable in a manner similar to that which is adopted for the register of an electronic organ.

What is claimed is:

1. A system for producing electrical signals representing sounds of predetermined pitch and variable loudness value, wherein signals for each sound of predetermined loudness value comprise component signals corresponding to partial tones of said sound, said component signals having frequencies above a fundamental frequency determing the pitch of the sound and forming a spectral amplitude/frequency pattern when the amplitudes are plotted as a function of their frequency, and including at least one formant region represented by a maximum in said amplitude/-frequency pattern;

said spectral amplitude/frequency pattern determining the timbre of the sound;

signals representing sounds of different loudness values differing in the shape of the amplitude/frequency pattern of the component signals;

said system comprising a signal source including means (12, 14; 30, 34, 36) providing at least first and second signal versions for each sound of predetermined pitch, said first and second signal versions having component signal forming different first and second spectral amplitude/frequency patterns corresponding to different first and second loudness values, respectively;

sound volume control means (20) for selecting a desired sound loudness value in a range between said first and second loudness values;

control means (**16, 16*a*; 18, 18*a*; 40, 42, 44*a*, 46, 48) connected to and controlled by the sound volume control means and further connected to the means (12, 14; 30, 34, 36**) providing said signal versions for selecting a portion of said first signal version and a portion of said second signal version, the selection of the respective portions being controlled by said sound volume control means, for selecting the said sound loudness value and to vary said first and second portions inverse to each other and in accordance with the variations of the setting of said sound volume control selecting means;

and means for combining said selected signal portions into a combined signal, which is the electrical sound signal to be produced.

2. System according to claim 1, wherein the means providing said at least first and second signal versions for each sound of predetermined pitch comprise means (34, 36) to provide signal versions free from the component signal corresponding to the fundamental tone of the sound.

3. System according to claim 1, wherein said control means (**16, 18; 16*a*, 18*a*) comprises respective potentiometers having their sliders (16*a*, 18*a*) coupled together and to said sound volume control means (20**).

4. System according to claim 3, wherein said potentiometers (16, 18) are differentially connected to the respective means providing, respectively, the first and second signal versions to provide an increasing level of one of said signal portions to the combining means while providing a decreasing level of the other of said signal portions to said combining means.

5. System according to claim 1, wherein said means (30, 34, 36) providing said at least first and second signal versions comprises filter circuits (34, 36) of respective controllable gain and band-pass characteristics.

6. A method of producing electrical signals representing sounds of predetermined pitch and variable selectable loudness value, and having respective timbre corresponding to the loudness value selected, wherein said electrical signals comprise component signals representing partial tones of said sound having frequencies above a fundamental frequency determining the timbre of said sound, said component signals forming a spectral amplitude/frequency pattern of predetermined shape when the amplitudes are plotted as a function of their frequency, said pattern including at least one formant region represented by a maximum in said pattern, said method comprising the steps of providing at least first and second signal versions for each sound of predetermined pitch, said first and second signal versions having component signals forming different first and second spectral amplitude/frequency patterns corresponding to different first and second loudness values, respectively;

selecting a portion of said first signal version, and selecting a portion of said second signal version in accordance with a desired sound loudness value, said selection step including selecting said sound loudness values of said first and second portions inverse to each other to increase the level of a first portion when the level of the other portion decreases, or vice versa;

and combining said selected signal portions into a combined signal to produce said electrical signals representing said sounds of predetermined pitch and timbre.

7. Method according to claim 6, wherein said step of providing at least said first and second signal versions includes the step of excluding component signal portions corresponding to the fundamental tone of the sound.

* * * * *